United States Patent [19]

Bock

[11] Patent Number: 4,586,435

[45] Date of Patent: May 6, 1986

[54] ELECTRIC DETONATOR

[75] Inventor: Immo E. Bock, Randburg, South Africa

[73] Assignee: Johannesburg Construction Corporation (PTY) Ltd., Johannesburg, South Africa

[21] Appl. No.: 605,943

[22] Filed: May 1, 1984

[30] Foreign Application Priority Data

| | | | |
|---|---|---|---|
| May 3, 1983 | [ZA] | South Africa | 83/3118 |
| Jul. 26, 1983 | [ZA] | South Africa | 83/5437 |
| Aug. 2, 1983 | [ZA] | South Africa | 83/5631 |

[51] Int. Cl.[4] ..... F42C 19/12; F42B 3/12

[52] U.S. Cl. ..... 102/202.5

[58] Field of Search ..... 102/202.5, 202.7, 202.11

[56] References Cited

U.S. PATENT DOCUMENTS

| | | | |
|---|---|---|---|
| 2,802,422 | 8/1957 | Horne | 102/202.7 |
| 2,980,019 | 4/1961 | Noddin | 102/202.7 |
| 3,160,789 | 12/1964 | Morgan | 102/202.7 |
| 3,351,012 | 11/1967 | Wilson | 102/202.7 |
| 4,190,413 | 2/1980 | Shaffer et al. | 102/202.5 |

OTHER PUBLICATIONS

Harseim, Bernardo, Jun. 11, 1984, Letter.

*Primary Examiner*—Charles T. Jordan

*Attorney, Agent, or Firm*—Biebel, French & Nauman

[57] ABSTRACT

An electric delay detonator 10 has a base charge 14, an ignition charge 16 and a fuse element 26 formed from a strip of zirconium. The zirconium strip 26 is forked at both ends having forks 36 which define an ignition portion and forks 34 which define a fuse portion. The forks 34 and 36 have a body portion 38 between them. The fuse portion is adjacent the ignition charge. The fuse element 26 is mounted in a carrier 24 by means of the forked portions 34 and 36. In one embodiment the forked portions 36 are attached to firing wires 28. In another embodiment the detonator has three forks 44.1, 44.2 and 44.3 at its ignition portion, two of the forks being connected to firing wires and the third fork being connected to a control wire. In a further embodiment one firing wire is connected to one end of the fuse element and the other firing wire to the other end. In still a further embodiment, a filament having an incendiary bead is connected to the firing wires, the bead being close to the ignition end of the zirconium strip. Finally there is a space between the fuse portion and the ignition charge to provide electrostatic protection with a bead of lead styphnate being provided on the fuse element to bridge the space and ignite the ignition charge. In use the zirconium strip is ignited at its ignition end and burns along its length at a controlled rate and after a predetermined period it ignites the ignition charge.

56 Claims, 4 Drawing Figures

ELECTRIC DETONATOR

Figure 1:
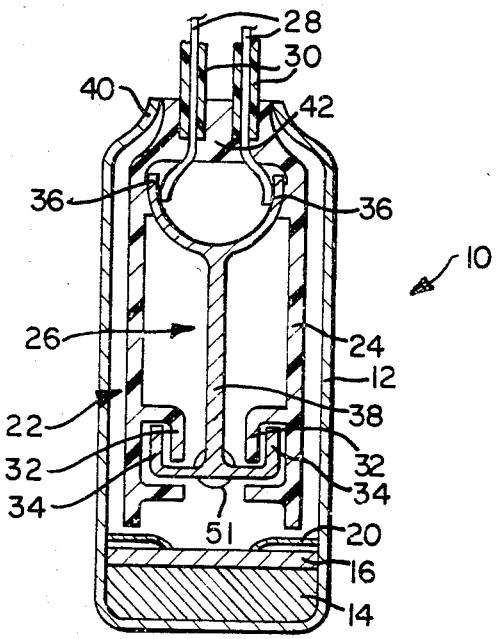

This invention relates to an electric detonator.

According to the invention there is provided an electric detonator which includes a fuse element which is of a combustible material;

a heat-sensitive ignition charge which is responsive to the fuse element; and a base charge.

The fuse element may have a suitably low combustion temperature.

In one embodiment, the fuse element may be electrically conducting and it may be ignited upon the passage through at least a part thereof of an electric current of a predetermined magnitude. Alternatively, the fuse element may be electrically non-conducting and it may be ignited by means of a separate filament. This filament may be coated with a suitable incendiary material or may have a bead of the incendiary material affixed thereto.

It is, however, preferred that the fuse element is electrically conducting and that after combustion it is electrically non-conducting. Then, the detonator may comprise part of an electric circuit utilised to sequentially activate a number of detonators.

It will accordingly be appreciated that the detonator may include a pair of electrical firing connections whereby the detonator may be connected to a firing means. The fuse element will then be connected to the firing connections at spaced apart positions if the fuse element itself is conducting or the filament may be connected to the connections.

A third connection, for control purposes may also be provided. This control connection is then utilised to enable or disable susequent or preceding electric detonators in a series thereof.

When the fuse element is itself conductive and the electric current is passed through it, the electric current may be passed through a portion of the fuse element or through substantially the entire fuse element. Thus, one of the firing connections may be connected to one end of the fuse element and the other firing connection to the other end of the fuse element.

The fuse element may particularly be of a pyrophoric material. Thus, the fuse element may be of metal and may particularly be zirconium.

The fuse element may still further be of a suitable material such that it remains integral after combustion.

An oxidising material may be provided for assisting combustion of the fuse element. This may be effected by providing a suitable oxidising atmosphere or by providing an oxidising coating on the fuse element. The oxidising material may be oxygen, nitrogen, chlorine, fluorine or the like.

It will be appreciated that the fuse element may comprise a single component which is itself of the combustible material or it may comprise of a plurality of components. Thus, it may comprise an insulating base with a suitable coating that is of a combustible material.

Where the fuse element is electrically conductive and current flows through it, it may have a narrowed region where it is narrower such that the resistance at this region is greater than elsewhere. This will have the result that combustion initially occurs at this narrowed region as the fuse element will be heated to a greater extent at this region than elsewhere.

Thus, as an important feature of the invention, the fuse element may be elongate and may have an ignition portion, a delay portion and a fuse portion which is located adjacent the ignition charge. The result of this will be that the detonator is a delay detonator, the delay time being defined by the length of the delay portion and the combustion rate of the fuse element. It will now be appreciated why it is desirable that the fuse element become non-conducting once it has combusted. As a result of this feature, once combustion occurs at the ignition portion, current no longer flows through the fuse element and combustion does not initiate at any other position along the fuse element.

The Applicant has found that with suitable materials, they tend to quench if they come into contact with any other material. The Applicant has found further that suitable materials, in particular zirconium, tend to increase in length when they combust. Thus, it has been found that fuse element strips tend to buckle whilst combusting and there is accordingly a possibility that the element will come into contact with a housing in which it is located. Thus, the fuse element may be mounted in a housing such that it is able to extend in length without buckling. This may be achieved by having an elongate fuse element that is forked at one end to define forked portions, with the fuse element then being mounted on a suitable carrier or the housing by means of these forked portions.

The fuse element may be spaced from the ignition charge or may be separated therefrom by a partition. The partition may be solid or it may have an aperture. If the fuse element is spaced from the ignition charge to provide electrostatic protection then an auxiliary incendiary or ignition element may be provided on or adjacent the fuse element, which is ignited by the fuse element and bridges the spacing between the fuse element and the ignition charge, to initiate the ignition charge.

Figure 2:
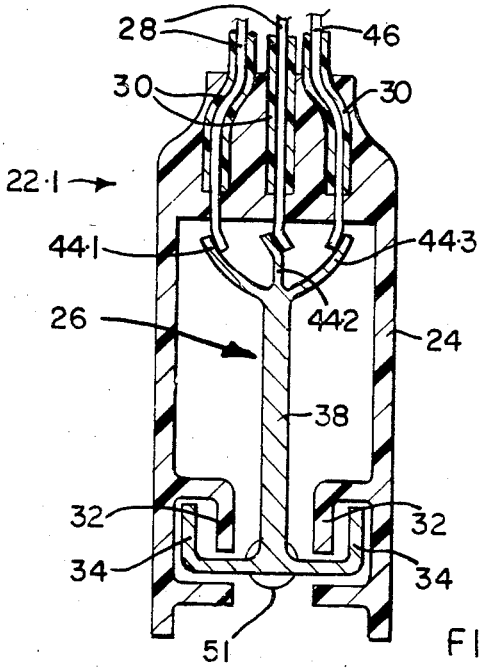
Figure 3:
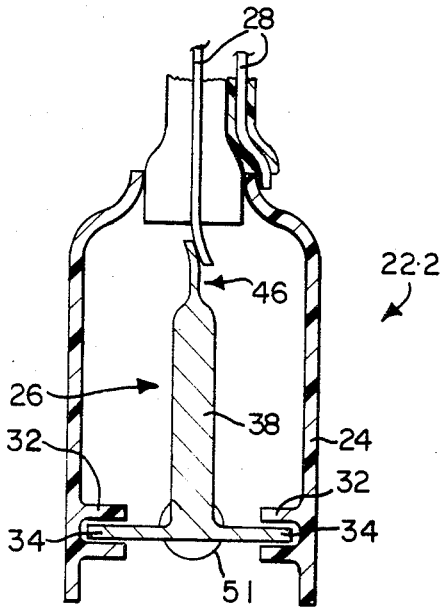
Figure 4:
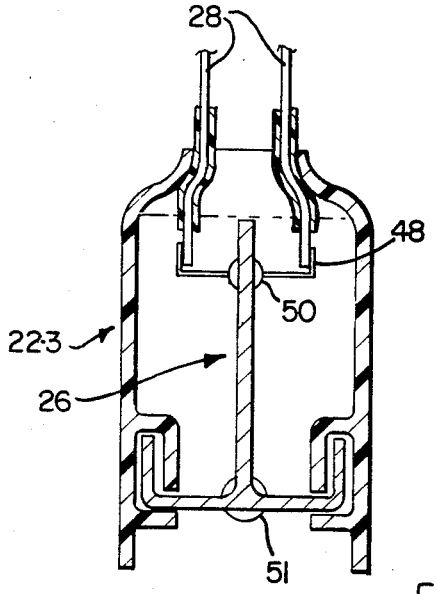

The invention is now described, by way of examples, with reference to the accompanying drawings, in which:

FIG. 1 shows a schematic section view of an electrical delay detonator in accordance with the invention; and FIGS. 2, 3 and 4 show parts of further embodiments of electric delay detonators in accordance with the invention.

Referring to FIG. 1, shown therein designated generally by reference numeral 10 is an electric delay detonator.

The detonator 10 comprises a shell 12 that is of metal or a suitable synthetic plastics material and is open at one end. At its opposite end the shell 12 contains a base charge 14 and a heat-sensitive ignition charge 16. The space occupied by the base charge 14 and ignition charge 16 is closed off by a partition 20 that is an annular piece of aluminium with a central aperture. Alternatively, the partition could be continuous and be of a suitable material such as collodion (a cellulose tetranitrate).

The detonator 10 further comprises a fuse unit 22. The fuse unit 22 comprises a plastic carrier 24 that is substantially tubular, a fuse element 26 and firing connecting wires 28 that have insulation 30.

As shown, the carrier 24 has a support formation 32 at its lower end which is adjacent the partition 20 by means of which the fuse element 26 is supported and tensioned in the carrier 24.

The fuse element 26 is elongate, being a strip of zirconium. The strip of zirconium 26 is split at both ends to provide forked portions 34 at one end and forked portions 36 at its other end connected by a body portion 38. The firing wires 28 are connected to the free ends of the forked portions 36 such that a circuit is formed between the wires 28 via the forked portions 36. The strip of zirconium 26 has sufficient physical strength to be self-supporting.

A bead 51 of lead styphnate or any other heat sensitive explosive material is secured to the fuse element 26 at the junction between the forked portions 34 and body portion 38. This bead 51 ignites the ignition charge 16 across an air gap between the fuse element 26 and the ignition charge 16 which provides electrostatic protection.

The open end 40 of the shell 12 is crimped closed against a solid head portion 42 of the carrier 24 to hermetically seal the interior of the shell 12. The interior of the shell 12 is filled with a suitable, controlled, oxidising atmosphere which can conveniently be an oxygen and/or nitrogen containing gas, such as air.

In use, when a firing pulse of a suitable magnitude is applied to the firing wires 28, a current of sufficient magnitude to ignite the zirconium is passed through the forked portions 36. The combustion is sufficiently exothermic to be self-propogating and accordingly a burning front passes down the body portion 38 at a speed determined by the characteristics of the zirconium and the composition of the atmosphere.

When the burning front reaches the fusing forked portions 34, the bead 51 flares and the heat generated thereby bridges the gap between it and the ignition charge 16 (burning through any collodion partition) and the ignition charge 16 is initiated. This causes initiation of the base charge 14 and accordingly detonation of the explosive that is to be detonated. Thus, there is a delay between firing of the detonator and exploding of the base charge, such that the detonator is a delay detonator with the delay period being determined by the length of the fuse element 26, the characteristics of the zirconium and the composition of the atmosphere. Although the zirconium body portion 38 increases in length as a result of combustion, due to the mounting procedure utilising the forked portions 34, the body portion 38 does not come into contact with any other material which would result in quenching of combustion of the zirconium. The combustion product of the zirconium also has sufficient physical strength to remain self-supporting and further, the zirconium strip does not melt or go to a powder during combustion. Thus, it remains integral and intact prior to, during and after combustion so that it does not collapse onto the ignition charge 16 or the base charge 14 to cause premature detonation. Further, the zirconium strip does not collapse against the walls of the carrier 26 or shell 12 which would result in quenching of the combustion of the zirconium strip.

Referring now to FIG. 2, a further embodiment of a fuse unit 22.1 is shown. This unit is substantially similar to the unit 22 of FIG. 1 except that the fuse element 26 has three forked portions 44.1, 44.2 and 44.3 at its ignition end. The portions 44.1 and 44.2 are connected to the firing wires 28 whereas the portion 44.3 is connected to a control wire 46. It will be appreciated that when the portions 44.1 and 44.2 are ignited the portion 44.3 will also combust. Due to the fact that the zirconium is non-conducting after combustion, there will then be an open connection between the wire 46 and the wire 28 which can be utilised to control the sequence in which detonators are initiated.

Referring now to FIG. 3, a further embodiment of a fuse unit 22.2 is shown. This unit has a metal carrier 24. At its ignition end 46 the fuse element 26 is thinner than its body portion 38. Further, one firing wire 28 is connected to the fuse element 26 at this firing end 46 and the other firing wire 28 is connected to the carrier 24. Thus, in use, current flows through the entire fuse element 26. However, due to the fact that the fuse element 26 is narrowest at its ignition end 46 combustion of the zirconium takes place, initially, in this region and the burning front then moves down the body portion 38 as with the previous embodiments.

Referring now to FIG. 4, a further embodiment of a fuse unit 22.3 is shown therein. With this fuse unit 22.3, there is a tungsten or molybdenum filament 48 that has a bead 50 of an incendiary material in close proximity to the fuse element 26. The firing wires 28 are connected to the ends of this filament 48. Thus, with this embodiment, when current is passed through the filament 48, the bead 50 is ignited causing the fuse element 26 to ignite.

By means of the invention a compact and reliable electric delay detonator is provided.

I claim:

1. An electric detonator which includes a fuse element which is of a combustible material, is elongate and has an ignition portion, a delay portion, and a fuse portion;

a heat sensitive ignition charge which is responsive to the fuse element and is adjacent the fuse portion; and a base charge.

2. A detonator as claimed in claim 1, in which the fuse element has a suitably low combustion temperature.

3. A detonator as claimed in claim 1, in which the electric detonator has an auxiliary ignition element in close proximity to the fuse portion of the fuse element and the ignition charge is spaced from the fuse portion of the fuse element.

4. A detonator as claimed in claim 1, in which the fuse element is electrically conducting and which is ignited upon the passage through at least a part thereof of an electric current of a predetermined magnitude.

5. A detonator as claimed in claim 4, in which the fuse element is electrically non-conducting after combustion.

6. A detonator as claimed in claim 4, which includes a pair of electrical firing connecting means for connection to a firing means, the fuse element being connected to the firing connecting means at spaced apart positions.

7. A detonator as claimed in claim 6, which includes a control connecting means for connection to a firing means to control sequential firing of other detonators, the control connecting means also being connected to the fuse element.

8. A detonator as claimed in claim 1, which includes a pair of electrical firing connection means for connection to firing means, and a filament in sufficiently close proximity to the ignition portion of the fuse element to ignite it upon the passage of a predetermined current through the filament.

9. A detonator as claimed in claim 1, in which the fuse element is of a pyrophoric material.

10. A detonator as claimed in claim 9, in which the fuse element is of metal.

11. A detonator as claimed in claim 10, in which the fuse element is of zirconium.

12. A detonator as claimed in claim 1, in which the fuse element is of a suitable material such that it is self-supporting prior to, during and after combustion.

13. A detonator as claimed in claim 1, which includes an oxidising material for assisting combustion of the fuse element.

14. A detonator as claimed in claim 1, in which the fuse element comprises an insulating base with a suitable coating that is of a combustible material.

15. A detonator as claimed in claim 6, in which one firing connecting means is connected to one end of the fuse element and the other firing connecting means is connected to the other end of the fuse element.

16. A detonator as claimed in claim 1, in which the fuse element is strip-like.

17. A detonator as claimd in claim 1, in which the fuse element is in an oxygen-rich atmosphere.

18. An electric detonator which includes a fuse element which is of a combustible electrically conducting material which is ignited upon the passage through at least a part thereof of an electric current of a predetermined magnitude and which has a narrowed region where it is narrower, such that the resistance at this narrowed region is greater than elsewhere;

a pair of electrical firing connecting means for connection to a firing means, one of the electrical firing connecting means being connected to the fuse element on one side of the narrowed region and the other electrical firing connecting means being connected to the fuse element on the other side of the narrowed region;

a heat-sensitive ignition charge which is responsive to the fuse element; and a base charge.

19. A detonator as claimed in claim 18, in which the fuse element has a suitably low combustion temperature.

20. A detonator as claimed in claim 18, in which the electric detonator has an auxiliary ignition element in close proximity to the fuse element and the ignition charge is spaced from the fuse element.

21. A detonator as claimed in claim 18, in which the fuse element is electrically non-conducting after combustion.

22. A detonator as claimed in claim 21, which includes a control connecting means for connection to a firing means to control sequential firing of other detonators, the control connecting means also being connected to the fuse element.

23. A detonator as claimed in claim 18, in which the fuse element is of a pyrophoric material.

24. A detonator as claimed in claim 23, in which the fuse element is of metal.

25. A detonator as claimed in claim 24, in which the fuse element is of zirconium.

26. A detonator as claimed in claim 18, in which the fuse element is of a suitable material such that it is self-supporting prior to, during and after combustion.

27. A detonator as claimed in claim 18, which includes an oxidizing material for assisting combustion of the fuse element.

28. A detonator as claimed in claim 18, in which the fuse element comprises an insulating base with a suitable coating that is of a combustible material.

29. A detonator as claimed in claim 18, in which one firing connecting means is connected to one end of the fuse element and the other firing connecting means is connected to the other end of the fuse element.

30. A detonator as claimed in claim 18, in which the fuse element is strip-like.

31. A detonator as claimed in claim 18, in which the fuse element is in an oxygen-rich atmosphere.

32. An electric detonator which includes a fuse element which is of zirconium;

a heat sensitive ignition charge which is responsive to the fuse element; and a base charge.

33. A detonator as claimed in claim 32, which includes an auxiliary ignition element in close proximity to the fuse element and the ignition charge is spaced from the fuse element.

34. A detonator as claimed in claim 32, which includes a pair of electrical firing connecting means for connection to a firing means, the fuse element being connected to the firing connecting means at spaced apart positions.

35. A detonator as claimed in claim 34, which includes a control connecting means for connection to a firing means to control sequential firing of other detonators, the control connecting means also being connected to the fuse element.

36. A detonator as claimed in claim 32, which includes a pair of electrical firing connection means for connection to a firing means connected to a filament which is sufficiently close to the fuse element to ignite it upon the passage of a predetermined current through the filament.

37. A detonator as claimed in claim 34, in which one firing connecting means is connected to one end of the fuse element and the other firing connecting means is connected to the other end of the fuse element.

38. A detonator as claimed in claim 32, in which the fuse element is strip-like.

39. A detonator as claimed in claim 32, in which the fuse element is in an oxygen-rich atmosphere.

40. An electric detonator which includes a fuse element which is of a combustible material, is elongate and is forked at one end to define forked portions;

a carrier in which the fuse element is mounted by means of the forked portion;

a heat-sensitive ignition charge which is responsive to the fuse element; and a base charge.

41. An electric detonator as claimed in claim 40, in which the fuse element has a suitably low combustion temperature.

42. A detonator as claimed in claim 40, in which the electric detonator has an auxiliary ignition element in close proximity to the fuse element and the ignition charge is spaced from the fuse element.

43. A detonator as claimed in claim 40, in which the fuse element is electrically conducting and which is ignited upon the passage through at least a part thereof of an electric current of a predetermined magnitude.

44. A detonator as claimed in claim 43, in which the fuse element is electrically non-conducting after combustion.

45. A detonator as claimed in claim 43, which includes a pair of electrical firing connecting means for connection to a firing means, the fuse element being connected to the firing connecting means at spaced apart positions.

46. A detonator as claimed in claim 45, which includes a control connecting means for connection to a firing means to control sequential firing of other detonators, the control connecting means also being connected to the fuse element.

47. A detonator as claimed in claim 40, which includes a pair of electrical firing connection means for connection to a firing means connected to a filament which is sufficiently close to the fuse element to ignite it upon the passage of a predetermined current through the filament.

48. A detonator as claimed in claim 40, in which the fuse element is of a pyrophoric material.

49. A detonator as claimed in claim 47, in which the fuse element is of metal.

50. A detonator as claimed in claim 49, in which the fuse element is of zirconium.

51. A detonator as claimed in claim 40, in which the fuse element is of a suitable material such that it is self-supporting prior to, during and after combustion.

52. A detonator as claimed in claim 40, which includes an oxidizing material for assisting combustion of the fuse element.

53. A detonator as claimed in claim 40, in which the fuse element comprises an insulating base with a suitable coating that is of a combustible material.

54. A detonator as claimed in claim 45, in which one firing connecting means is connected to one end of the fuse element and the other firing connecting means is connected to the other end of the fuse element.

55. A detonator as claimed in claim 40, in which the fuse element is strip-like.

56. A detonator as claimed in claim 40, in which the fuse element is in an oxygen atmosphere.

* * * * *